US006123434A

United States Patent [19]

Meltzer

[11] Patent Number: 6,123,434

[45] Date of Patent: Sep. 26, 2000

[54] FLUORESCENT ANGLE LIGHT

[75] Inventor: Edward Meltzer, Brooklyn, N.Y.

[73] Assignee: American Electric Cord International Ltd., Tortola, Virgin Islands (Br.)

[21] Appl. No.: 09/236,528

[22] Filed: Jan. 25, 1999

Related U.S. Application Data

[60] Provisional application No. 60/092,427, Jul. 10, 1998.

[51] Int. Cl.[7] ..... F21W 111/00; F21V 14/02

[52] U.S. Cl. ..... 362/260; 362/220; 362/285; 362/287; 362/427

[58] Field of Search ..... 362/260, 225, 362/223, 220, 285, 287, 184, 190, 191, 196, 197, 199, 427, 250

[56] References Cited

U.S. PATENT DOCUMENTS

| | | | |
|---|---|---|---|
| 4,321,657 | 3/1982 | Hoi | 362/184 |
| 4,432,043 | 2/1984 | Yuen | 362/223 |
| 5,467,258 | 11/1995 | Bamber et al. | 362/184 |
| 5,649,759 | 7/1997 | Korte | 362/260 X |
| 5,921,658 | 7/1999 | Kovacik et al. | 362/199 |

*Primary Examiner*—Laura K. Tso
*Attorney, Agent, or Firm*—Herold and Haines, P.A.; Brian L. Wamsley, Esq.

[57] ABSTRACT

The invention relates to a fluoresent worklight having a fluorescent lamp socket as an integral part of an adjustable lens. The lampholder lens is positioned between two half-shells of the worklight handle. Two arcuate flanges are provided at one end of the lampholder lens which fit into two associated arcuate tracks on the inside of the handle. This arrangement allows the entire lampholder lens and lamp, as an integral unit, to pivot as much as 90° from the handle to provide easy access to the lamp for removal and replacement as well as positioning the lamp to provide more efficient lighting to the work site.

6 Claims, 5 Drawing Sheets

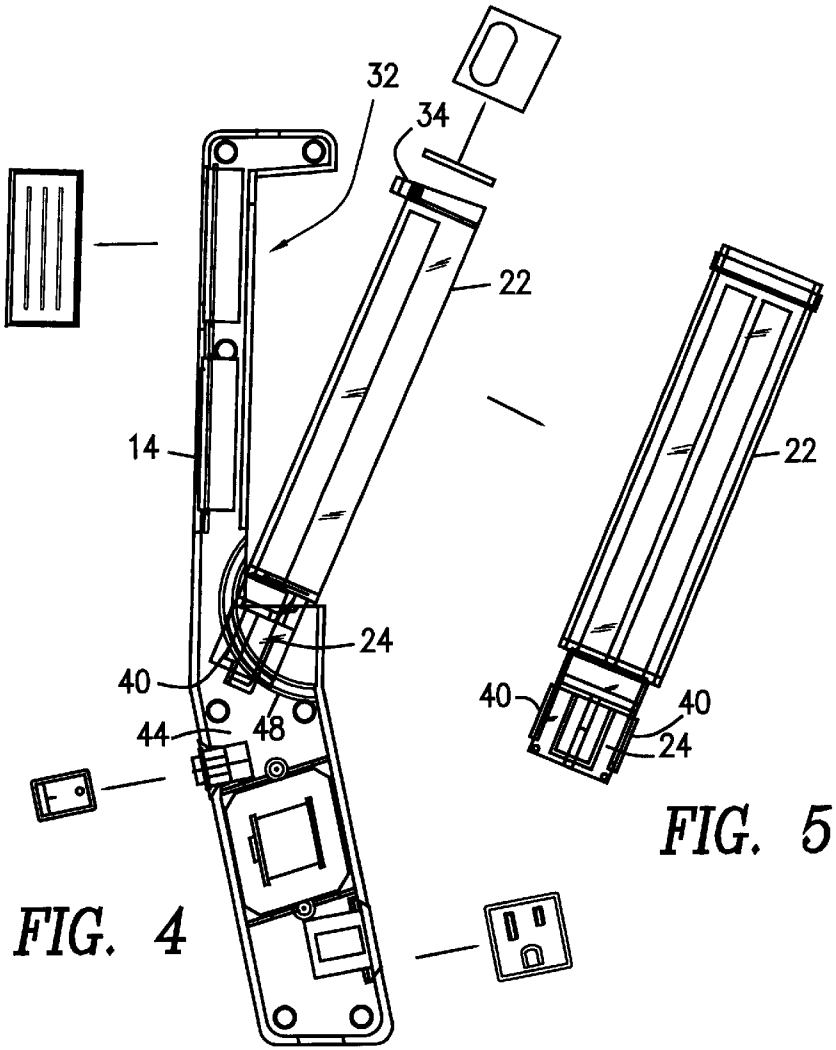
FIG. 5
FIG. 4
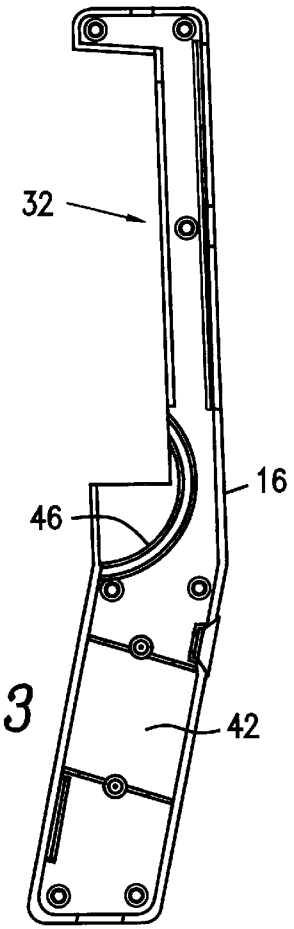
FIG. 3

FLUORESCENT ANGLE LIGHT

This application is based on a provisional patent application No. 60/092,427 filed under 37 C.F.R. § 1.53(b)(2) on Jul. 10, 1998. The disclosure and information contained therein is incorporated here by reference.

BACKGROUND OF THE INVENTION

The present invention relates to a fluorescent worklight and, more particularly, a fluorescent worklight having the lamp socket as an integral part of an adjustable lampholder lens. This lampholder lens allows for positioning of the lamp towards the worksight and for simple replacement and removal of the lamp.

The use of electrical worklights in industry as well as in the home is widely known. Worklights are used in situations where additional illumination is required due to the impairment of other sources of light. Worklights frequently encounter severe service conditions when used in certain situations such as the servicing of mechanical equipment and in tight quarters.

Worklights can be either of the incandescent or fluorescent lamp varieties. Where the fluorescent type worklight is employed, it is known in the art that a clear plastic lens is used which covers the entire fluorescent lamp as part of the light housing. The lens protects the delicate fluorescent lamp which is typically configured as an elonganted tube. Usually, the lens is attached to the housing by screws, plastic tabs or clips and must be removed entirely to provide access to the lamp for removal or replacement. Thus several inconvenient steps are necessary in the task of replacing a fluorescent lamp. This is further exacerbated in the fluorescent worklight in the known art because one end of the fluorescent lamp is connected to an electrical socket within the worklight housing and the other end is held in place within the housing, commonly by a rubber gasket or similar device.

In addition, the lens also confines the fluoresecent lamp within the housing and does not allow for positioning of the lamp itself with relation to the worksight. That is, the direction of illumination of the worksight is limited to the positioning of the worklight itself, which can be quite awkward and inefficient in a tightly confined workspace. Even if the lens were removed, it would be impractical to angle the fluorescent lamp to provide better illumination because the lamp is fixed in the socket in the handle of the worklight and held in position by the rubber gasket. Removal of the lens would also remove the protective features of the lens with respect to the lamp.

It is therefore an object of the present invention to provide a fluorescent worklight where the fluorescent lamp can be angled with respect to the worklight to provide more efficient illumination of the workpiece where necessary. It is also an object of this invention to maintain a degree of protection of the fluorescent lamp while it is extended from the worklight.

It is a further object of the invention to provide a fluorescent worklight where it is an easier task to remove and replace the lamp.

SUMMARY OF THE INVENTION

The present invention relates to a fluorescent worklight and, more particularly, a fluorescent worklight having the lamp socket as an integral part of an adjustable lampholder lens.

In accordance with the present invention, two cooperating half shells attached to one another by fasteners form a worklight housing. About half of the length of the worklight housing is configured as a handle. The other "half" of the length of the worklight housing consists of a large opening for accommodating the fluorescent lamp.

The opening in the worklight housing containing the fluorescent lamp is covered by an adjustable lampholder lens. One end of the lampholder lens has tabs or clips for removably fastening the lens to the worklight housing at one end of the opening. The other end of the lens is extended beyond the length of the housing opening and is inserted into the housing at the opposite end of the housing opening. The lens is designed to have a "U" -shaped cross-section so that the sides of the U-shape parallel the configuration of the inside of the worklight housing. Each "side" of the extended part of the lampholder lens contains a curved flange on its outer surface, the surface facing the interior wall of the worklight housing. Each curved flange is inserted into an arcuate track located on the inside of each of the half shells near the end of the opening for receiving the extended end of the lampholder lens.

The extended end of the lampholder lens is also configured as the socket into which the fluorescent lamp is connected, forming an integral lens/socket unit. Electrical contacts for receiving the plug end of the lamp are contained within the lens/socket unit. When the lamp is inserted into the socket end of the lampholder lens, the lamp and lens also act as an integral unit. This is important for the proper operation of the adjustable lampholder lens to achieve the desired objectives.

When the worklight is fully assembled, the user can attain easy access to the fluorescent lamp for removal or replacement, or to postion the fluorescent lamp more advantageously, by disengaging the distant end of the lampholder lens removably attached at the distant end of the housing opening. The lampholder lens may then pivot away from the worklight housing by the movement of the curved flanges on the socket end of the lampholder lens within the arcuate tracks on the inside of the worklight housing. The lampholder lens may be pivoted from the worklight housing in this manner in an arc of varying degrees, with 90 degrees being a practical limitation.

Because the lamp socket is an integral part of the lampholder lens, the lamp, when plugged into the socket, moves in conjunction with the lens. In this manner, the lamp is positionable in an arc of up to 90 degrees with respect to the worklight housing to provide angled illumination to the work. Also, when the worklight is opened in this manner, the lamp may be easily accessed and replaced.

BRIEF DESCRIPTION OF THE DRAWINGS

The above objects and advantages of the invention will become manifest to one skilled in the art from considering the following detailed description of an embodiment of the invention in light of the accompanying drawings, in which:

FIG. 3 is an interior sectional view of the left housing section taken along line 3—3 of FIG. 2;

FIG. 4 is an interior sectional view of the right housing section taken along line 3—3 of FIG. 2;

FIG. 5 is a frontal view of the lampholder lens/lamp socket integral unit;

DETAILED DESCRIPTION OF THE INVENTION

Figure 1:
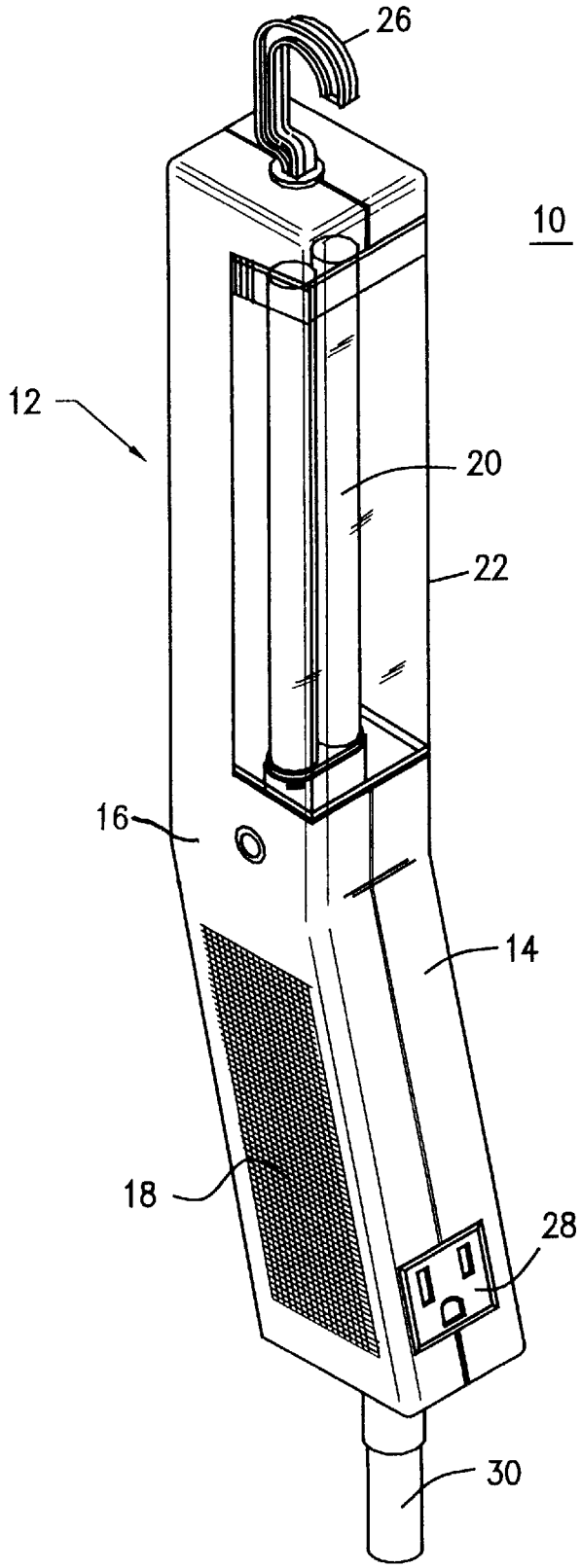
FIG. 1 is a perspective view of the fluorescent angle worklight in accordance with the present invention.

Turning now to the drawings, there is illustrated in FIG. 1 a fluorescent worklight 10, including a worklight housing 12, comprised of a right half shell 14 and a left half shell 16, a handle portion 18, a fluorescent lamp 20, a lampholder lens 22, a hook for hanging the worklight 26, an electrical receptacle 28 and an electric power cord 30.

The worklight housing 12 is constructed of an electrical insulator material such as plastic, for example, and is configured as an elongated, hollow structure which houses the electrical components. The hollow structure of the housing could have any of a number of cross-sectional configurations such as round, oval, rectangular or, as shown, square. One end of the worklight housing, which comprises about half of its length, serves as a handle portion 18. The handle portion 18 may consist of a cross-hatch pattern, or similar design, molded into the plastic of the housing to afford the user with a gripping surface.

Figure 2:
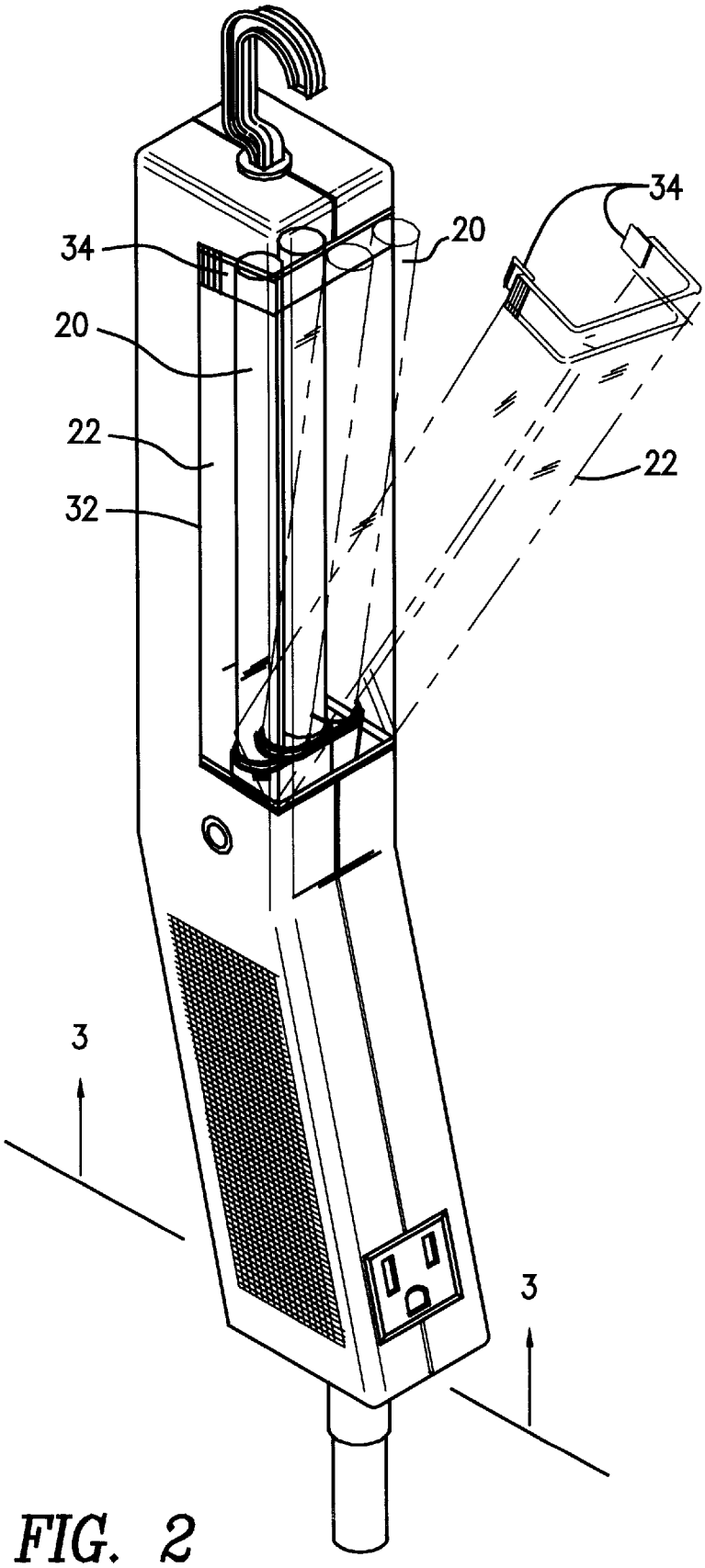
FIG. 2 is a further view of the fluorescent angle worklight of FIG. 1 with the lampholder lens in an open position.

The length of the housing 12 opposite the handle portion 18 is configured as an opening 32 for housing the fluorescent lamp 20 (see FIG. 2). The preferred embodiment of this invention is designed to accommodate the common type of fluorescent lamp having a double tubular design and electrical prongs on one end. Accordingly, the housing opening 32 is also elongated to accommodate the lamp, and extends over most of the remaining length of the worklight housing that is opposite the handle portion. The lamp 20 is connected to the worklight by plugging the prongs into a lamp socket 24 located inside the housing 16 and formed as an integral part of the lampholder lens 22 (see FIG. 5), further described below.

The lampholder lens 22 is designed to fit into the entire housing opening 32, essentially becoming part of worklight housing 12. The lampholder lens 22 has a "U"-shape configuration to fit over the fluorescent lamp and provide protection therefor. Made of clear plastic material, the lens allows illumination from the lamp to pass through. The lampholder lens 22 is removably attachable to the worklight housing 12 at the end of the opening 32 distant from the lens socket end 24, by means of tabs or clips 34. The tabs or clips 34 are constructed as part of the lampholder lens 22 and are of the same material. The lampholder lens 22 being plastic, has an inherent degree of flexibility which allows the tabs 34 to be compressed towards each other by the user, such that the tabs 34 can be inserted into the housing opening 32, holding the lens secure at that point.

Figure 5A:
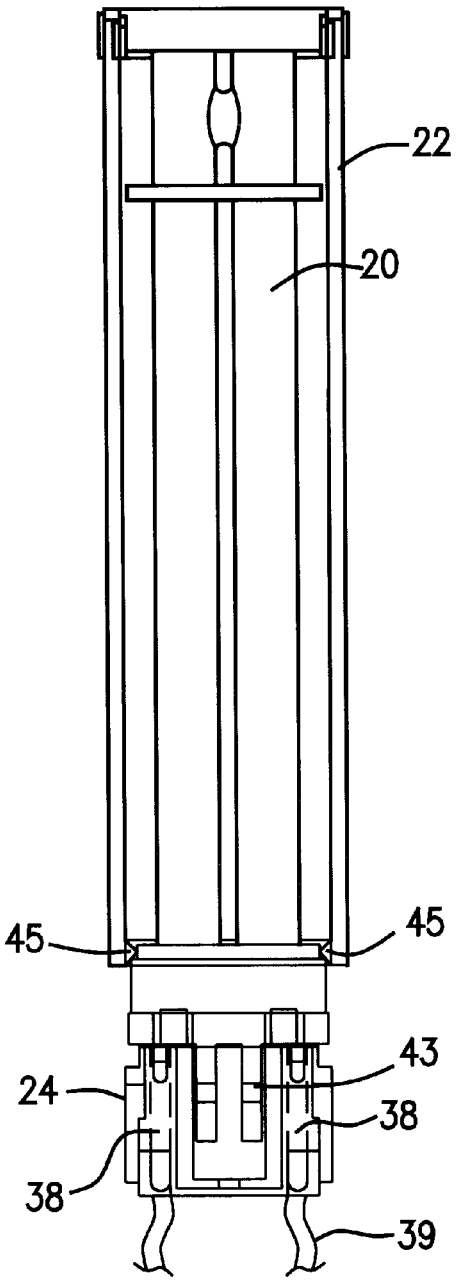
FIG. 5*a* is an inside view the lampholder lens/lamp socket integral unit with the lamp inserted.
Figure 5B:
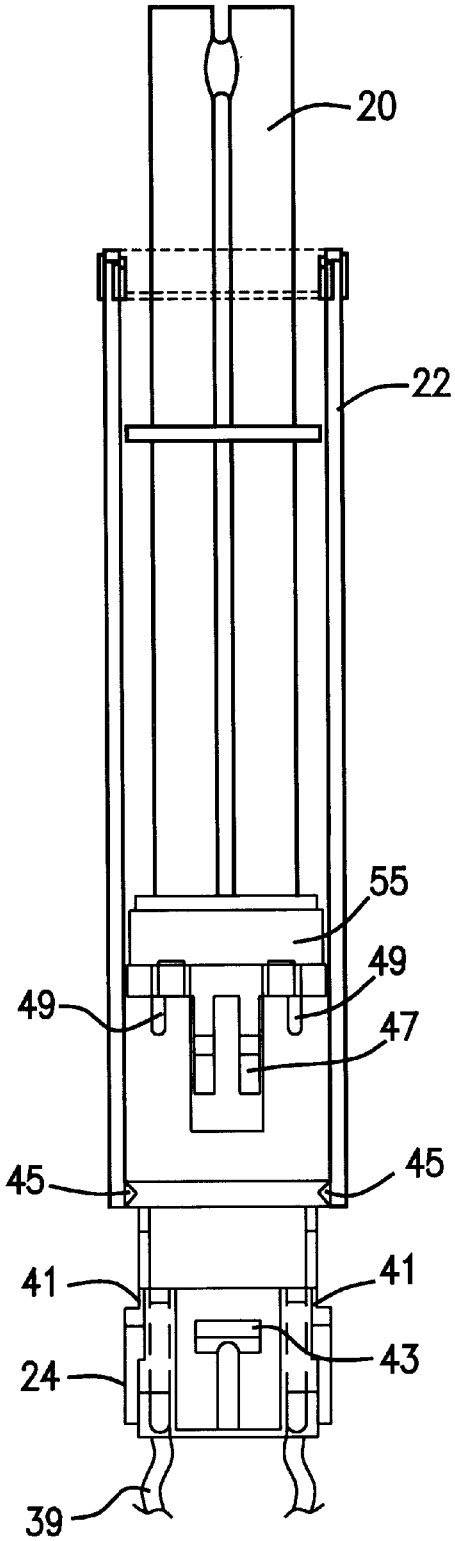
FIG. 5*b* is an inside view of the lampholder lens/lamp socket integral unit with the lamp in a pre-insertable position.

Referring to FIGS. 4 and 5, the end of the lampholder lens 22 opposite the end having the tabs 34 extends beyond the length of the housing opening 32 and is configured as a socket for receiving the prongs of lamp 20. This socket end 24 of the lens 22 fits into the worklight housing 12 at the near end of housing opening 32 when the worklight is assembled. The socket end 24 of the lens 22 has the same U-shape as the lens 22, forming a compartment for holding the lamp 20. The interior of the compartment can be of any suitable design for accommodating and holding the lamp 20. In the preferred embodiment shown herein, the prongs 49 of the fluorescent lamp 20 are plugged into electrical connectors 38 that are inserted into the socket end 24 of the lampholder lens 22. Attached to the ends of the electrical wires 39, the electrical connectors 38 are embedded in plastic holders 41 that are molded into the socket end 24 section of the lens 22. A plastic clip 47 with locking tabs 43 holds the lamp base 55 (and lamp 20) in place in the lens socket end 24, assisted by "side tabs" 45. See FIGS. 5*a* and 5*b*. FIG. 5*a* shows the lampholder lens 22 with lamp 20 inserted into socket end 24. FIG. 5*b* shows the lamp 20 prior to insertion or just after removal from the socket end 24.

Figure 6:
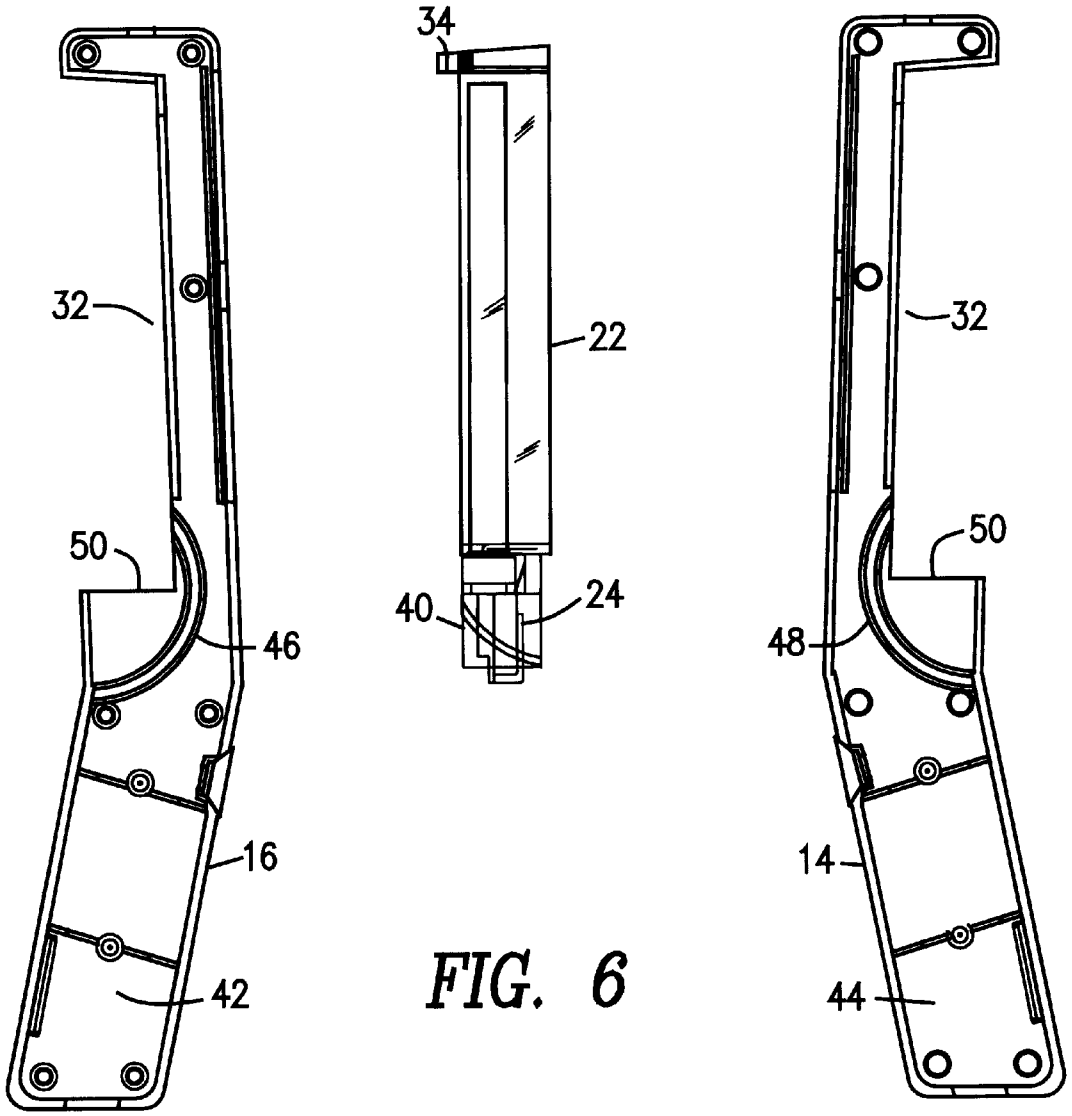
FIG. 6 is an exploded view of the left and right housing sections and a side view the lens/socket unit.

Referring now to FIG. 6, the two outer sides of the socket end 24 each contain a curved flange 40 facing outwardly and toward the inner sides 42, 44 of the housing half shells 14, 16. The curve flanges 40 fit into two corresponding arcuate tracks 46, 48 located on the interior sides 42,44 of half shells 14, 16. The arcuate tracks 46, 48 are positioned at the end 50 of the opening 32 in a manner such that they receive the corresponding flanges 40 of the lampholder lens 22 when the lampholder lens 22 is in a closed position covering the housing opening 32. The closed position is seen in FIG. 1.

Both the flanges 40 and the arcuate tracks 46, 48 have the same radius of curvature. This feature allows the flanges 40 to slide smoothly within the tracks 46, 48. When the lampholder lens 22 is opened, the radius acts as a pivot allowing the lens 22 to swing away from the worklight housing 12. Although the lampholder lens may theoretically pivot any number of desired degrees from the housing, a practical limit may be 90 degrees as determined by the profile of the housing opening. In the embodiment shown, the lampholder lens 22 may pivot from 0 to 90 degrees to allow access to the fluorescent lamp or to position the lamp more advantageously.

While the present invention has been explained in relation to its preferred embodiment, it is to be understood that various modifications thereof will be apparent to those skilled in the art upon reading this specification. The invention disclosed herein is therefore intended to cover all such modifications that fall within the scope of the appended claims.

What is claimed is:

1. A fluorescent trouble light, comprising;

a housing comprised of a pair of complementary half shells cooperating to form said housing, said housing having a housing opening along part of its length for accommodating a fluorescent lamp and for receiving a lens for said lamp, said housing further comprising a handle portion along part of its length opposite said opening, a lens movably inserted in said housing opening, said lens comprising a socket end for receiving said fluorescent lamp, said socket end being movably mounted between the pair of complementary half shells forming the housing at a first end of the housing opening, said socket end having a first and second arcuate flange on a first and second side of said socket end for movably mounting the lens within the housing opening, and a pair of complementary arcuate tracks located on interior sides of each of the complementary half shells capable of slidably receiving said first and second arcuate flanges of said socket end, and cooperating with said arcuate flanges to allow the lens to pivot outward from the interior of said housing which permits for angling of the fluorescent lamp as well as access to the lamp to facilitate removal and replacement.

2. The fluorescent trouble light of claim 1, wherein said lens further comprises means for detachably connecting an end of the lens opposite the socket end of the lens to a second end of said housing opening, wherein detaching said lens at said second end of said opening causes said pivoting of said lens.

3. The fluorescent trouble light of claim 2, wherein said lens is pivotable in an arc of up to 90° from said housing opening.

4. The fluorescent trouble light of claim 1, wherein the socket end of the lens further comprises means for removably holding a fluorescent lamp.

5. The fluorescent trouble light of claim 1, wherein said socket end of said lens further comprises electrical connections for receiving prongs of a fluorescent lamp.

6. The fluorescent trouble light of claim 4, wherein said means for holding the fluorescent lamp comprise flexible plastic tabs.

* * * * *